United States Patent [19]

Maruyama

[11] Patent Number: 4,580,775

[45] Date of Patent: Apr. 8, 1986

[54] SHEET SORTING APPARATUS

[75] Inventor: Ryuhei Maruyama, Ibaraki, Japan

[73] Assignee: Ikegani Tsushinki Company, Ltd., Tokyo, Japan

[21] Appl. No.: 705,061

[22] Filed: Feb. 25, 1985

[30] Foreign Application Priority Data

Mar. 2, 1984 [JP] Japan ..... 59-38483
Mar. 2, 1984 [JP] Japan ..... 59-38484
Mar. 2, 1984 [JP] Japan ..... 59-38485

[51] Int. Cl.[4] ..... B65H 39/11; B65H 31/24

[52] U.S. Cl. ..... 271/293; 271/294; 271/296

[58] Field of Search ..... 271/293, 294, 296

[56] References Cited

U.S. PATENT DOCUMENTS 4,466,609 8/1984 Lawrence ..... 271/293
4,478,406 10/1984 Du Bois ..... 271/293
4,512,565 4/1985 Matsumoto ..... 271/293 X

*Primary Examiner*—Richard A. Schacher
*Attorney, Agent, or Firm*—W. Edward Johansen

[57] ABSTRACT

A sheet sorting apparatus, used with an image printing apparatus, having a plurality of shiftable trays arranged in a vertical array; a pair of vertically movable cams for shifting the trays and for forming sheet discharge zone; a sheet feeding mechanism; and sheet edge guides, which are vertically movable integrally with the cams, for aligning the sheets deposited on the trays. The sheet feeding mechanism includes a sheet inlet unit, the level thereof is adjustable to meet the sheet discharge level of the image printing apparatus, and a tiltable sheet conveyor which bridges the sheet inlet unit and the sheet discharge zone.

7 Claims, 10 Drawing Figures

SHEET SORTING APPARATUS

BACKGROUND OF THE INVENTION

1. Field of the Invention

This invention relates to a sheet sorting apparatus used with an image printing apparatus such as a copying machine.

2. Description of Prior Art

A sheet sorting device normally employs an array of trays. Trays of some conventional sorters are fixed. Comparatively complicated sheet conveying and distribution mechanisms are required with sorters having fixed trays. Such sorters are, therefore, generally bulky and costly. The complexity of the mechanism also tends to cause a sheet jamming.

For the past years, efforts have been made in the industry to make sheet sorters simpler in construction, more compact in size, thus lower in cost.

An ordinary conventional compact sheet sorting device of today has a plurality of vertically and slantly stacked trays for sorting and holding copy sheets. The trays are pivotingly vertically displaced by a set of cams in order to provide a wide open sheet discharge zone. The levels of the tray shifting cams and the sheet discharge zone of such a conventional compact sheet sorting device is normally fixed. The level of a sheet feeding mechanism attached to such a compact sorter is also normally fixed. An ordinary sheet feeding mechanism of a compact sorter includes a sheet inlet section for accepting sheets from the host sheet supplying 5 unit and possibly a sheet conveying mechanism for conveying the sheets to the discharge zone of the sorter. In a compact sorter having a fixed level sheet discharge zone the sorter has to provide an enough space for all of the trays, each of which may hold copy sheets to a full capacity, in each of the areas above and below the discharge zone. In other words, there is always a substantial idle space above and/or below the sheet discharge zone. This unavoidably increases the height of such a compact sorter.

Furthermore, a sorter having a fixed level sheet inlet section is not commonly adaptable to multiple kinds of host sheet supplying units with various levels of sheet outlets.

SUMMARY OF THE INVENTION

In view of the foregoing conditions which are characteristic of the prior art, it is an object of the present invention to provide a compact sheet sorting device having a plurality of trays yet occupying a space as little as half space of a conventional sheet sorting device.

It is another object of the present invention to provide a compact sheet sorting device having a plurality of trays the height of which may be substantially less than that of a conventional sheet sorting device.

It is a further object of the present invention to provide a compact sheet sorting device whose sheet inlet level can be adjustable to various sheet discharge levels of a plurality of image printing devices.

It is still another object of the present invention to provide a compact sheet sorting device with an improved sheet alignment in order to minimize the chance of sheet jamming.

DESCRIPTION OF THE PREFERRED EMBODIMENTS

Figure 1:
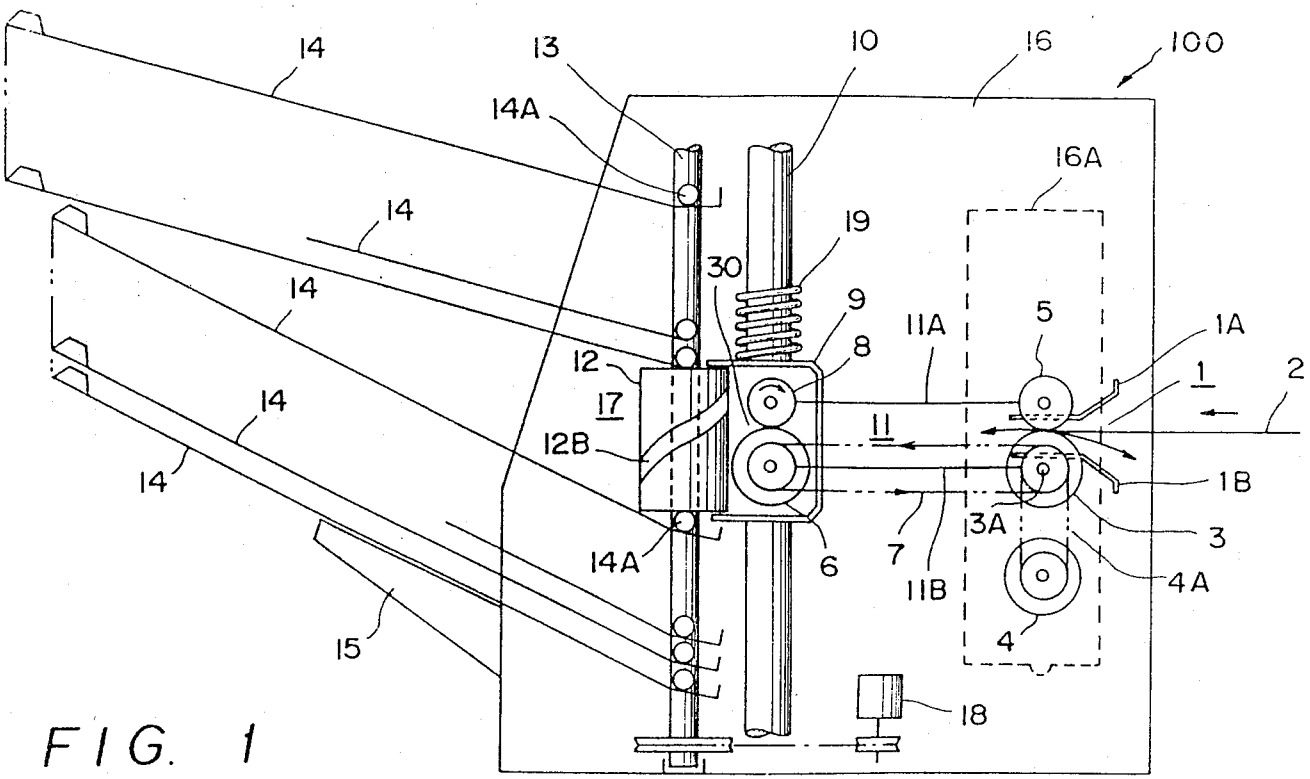
FIG. 1 is a side elevational schematic view of a sheet sorting device of the present invention.

Referring to FIG. 1, there is schematically described a sheet sorting apparatus 100 of the present invention. A sheet inlet 1 of the sheet sorting apparatus, a horizontally extended opening formed between a pair of horizontally disposed sheet guides 1A and 1B, is provided in order to accept sheets 2 from an image printing apparatus such as a copying machine. The level of the sheet inlet 1 is adjustable, as described in detail afterwards, so as to meet the level of the sheet discharge outlet of the image printing apparatus.

Figure 2:
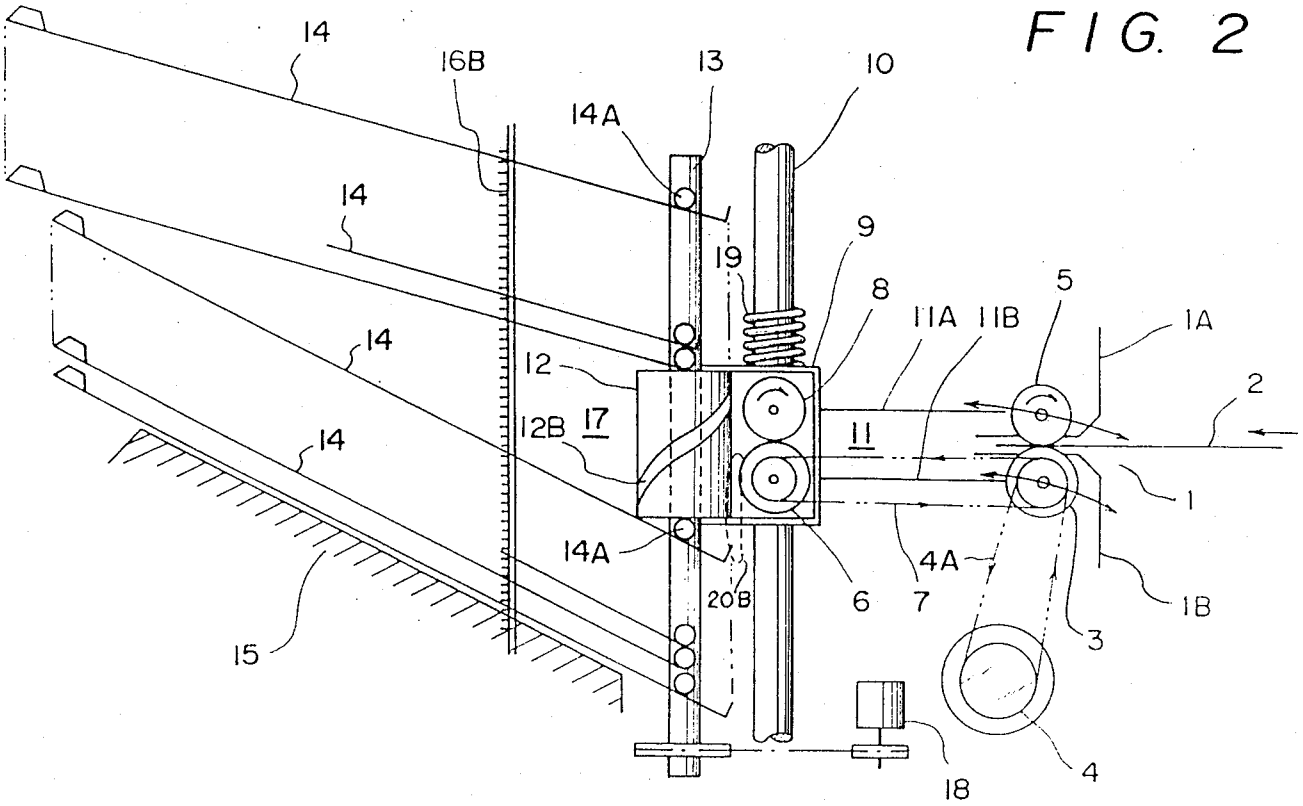
FIG. 2 is a side elevational schematic view in cross section of the sheet sorting device shown in FIG. 1.

Referring now to FIGS. 1 and 2, a pair of sheet feed rollers 3, 5 are provided adjacent to the sheet inlet 1 and are driven by a sheet feed motor 4, which is of a type having a rotational shaft, through a drive belt 4A. The rollers 3, 5 are arranged such that the shafts thereof are rotatingly movable, in the directions indicated by the curved arrows in FIG. 2, about the shaft of the motor 4. That is, the rollers 3, 5 and the drive belt 4A are integrally rotatingly movable about the shaft of the motor 4. Another pair of sheet feed rollers 6, 8 are provided and the shafts thereof are journaled to a frame 9. The frame 9 is mounted on a vertically disposed guide shaft 10 and is vertically slidingly movable along the guide shaft 10. The roller 6 is drivably coupled to the roller 3 by an endless sheet conveyor belt 7 and is driven therethrough so that the pair of rollers 6, 8 are simultaneously driven when the pair of rollers 3, 5 are driven by the sheet feed motor 4. A pair of vertically spaced, transversely extended parallel sheet guide plates 11A and 11B are pivotably coupled to the shafts of the rollers 5, 8 and to the shafts of the rollers 3, 6, respectively, in order to provide a sheet pathway 11 therebetween.

Figure 3:
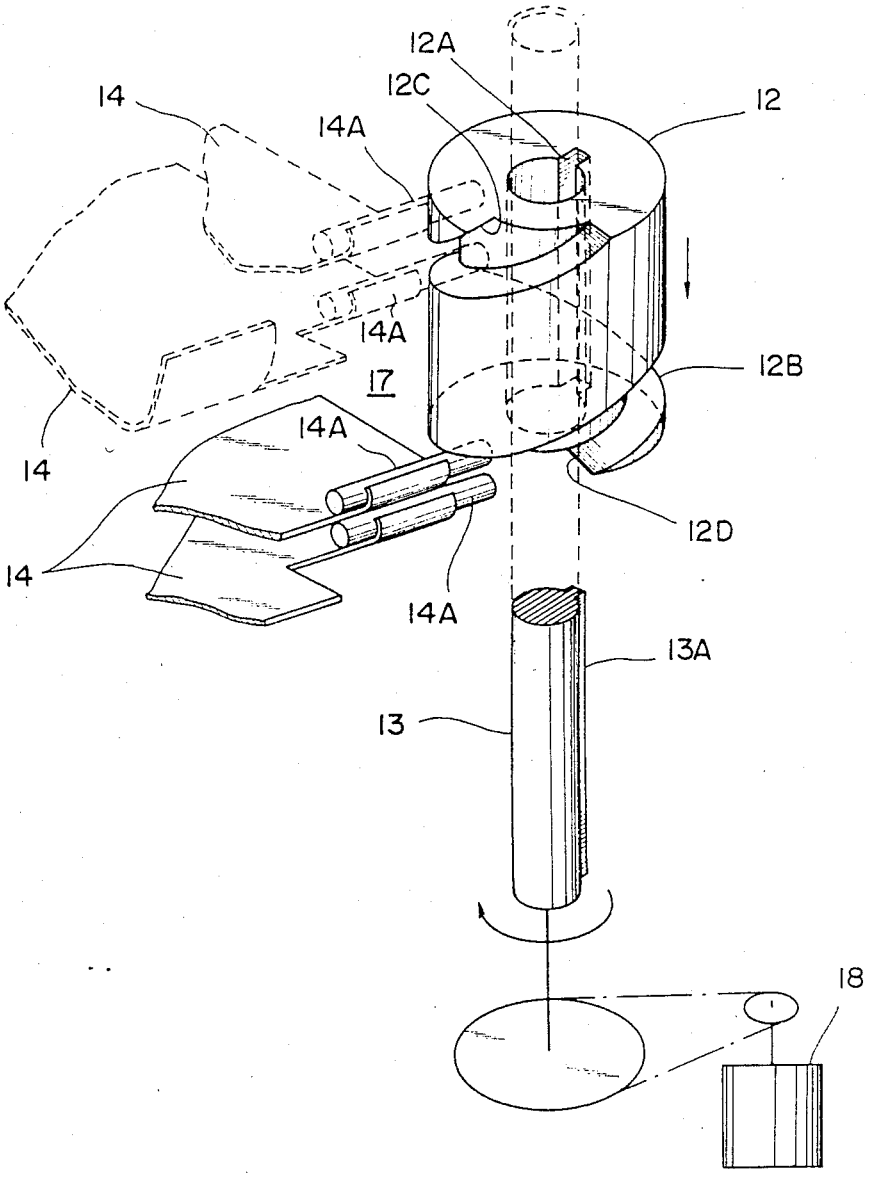
FIG. 3 is a perspective view of a section of the sheet sorting device shown in FIG. 1.

Referring to FIGS. 1, 2 and 3, a cylindrical cam 12 having a helical slot 12B is vertically slidingly movably mounted on a vertically disposed rotary drive shaft 13 having a vertical key 13A. The cam 12 has a center hole and a vertical key groove 12A through which the drive shaft 13 and the key 13A respectively fit, whereby the rotation of the drive shaft 13 will cause the cam 12 to rotate together therewith. The top and bottom sections of the frame 9 horizontally extend to and keep contacts with the top and bottom surfaces, respectively, of the cam 12, whereby the vertical movement of the cam 12 will cause the frame 9 to move vertically along the guide shaft 10 thereby integrally moving the pair of rollers 6, 8 vertically.

The sorting apparatus 100 has a frame structure 16. Each end of the guide shaft 10 is rigidly secured to the frame structure 16. Each end of the rotary drive shaft 13 is rotatably coupled to the frame structure 16.

Trays 14 upwardly inclined along the direction of the sheet feeding and vertically spaced are stacked up in multiple stage on a tray support 15 which is slantly disposed and rigidly mounted to the frame structure 16. Each tray is pivotable about the upward end thereof and capable of holding thereon a number of copy sheets.

A pair of tray pins 14A are provided being laterally extended and rigidly fixed to the opposite sides of each tray in the vicinity of the downward end thereof. All of the tray pins 14A are slidably engaged with a vertical guide slot 16C (shown in FIG. 6) formed in the frame structure 16 in the vicinity of, and in parallel with, the drive shaft 13.

Each end of the pins 14A is adapted to engage with the helical slot 12B of the cam 12, in the opposite side of the guide slot 16C (FIG. 6) to the tray, so that the pin can be moved upwardly or downwardly along the guide slot as the cam rotates, whereby the downward end of the tray held by the cam is raised or lowered, respectively. In this embodiment, the helical slot 12B is formed so that the pin 14A moves from the top to the bottom of the cam 12, or from the bottom to the top of the cam, depending on the rotational direction of the cam, as the cam makes one revolution.

The cam 12 provides a sufficient gap for the sheets being discharged onto the tray, namely a sheet discharge zone 17, between the two adjacent trays, one immediately on the cam, the other immediately under the cam. The tray immediately under the cam functions as a receiving tray which receives the sheets being discharged from between the sheet feed rollers 6 and 8. The spacings between trays other than the the sheet discharge zone are properly maintained by the tray pins and the spacers (not shown) attached to the upward ends of the trays.

Since the trays 14 are made of electrically conductive material, the sheets 2, which are electrically non-conductive, introduced to the sheet discharge zone 17 tend to collect static electricity and function as electric capacitors. The potential of such static electricity may reach as high as tens of kilovolts unless a proper static electricity discharge means is provided.

Referring to FIG. 2, an elongated static electricity discharge brush 16B is vertically disposed in the present embodiment in the manner its bristles lightly touch the side edges of the trays 14. The bristles of the brush 16B are made of an electrically conductive material such as carbon or stainless steel and are electrically grounded through the body of the brush which is also electrically conductive, whereby the sheets are discharged of static electricity through the trays. As the trays 14 move upwardly or downwardly, the sheets 2 deposited on three trays 14 make further sufficient contacts with one another and with the trays 14 by virtue of the weights of the sheets and the movements of the trays. Thus, the static electricity which may be otherwise still accumulated on the sheets 2 is further discharged through trays 14 and the static electricity discharge brush 16 as the trays make further movements.

Another static electricity discharge brush (not shown), which is shorter than the brush 16, is disposed in the vicinity of the roller 6 so that the sheet being advanced toward the sheet discharge zone 17 is preliminarily discharged of static electricity thereby.

Referring to FIGS. 1 to 3, a bidirectional motor 18 is installed to rotate the rotary drive shaft 13 through a pulley-belt arrangement. A coil spring 19 is slidingly movably engaged with the guide shaft 10 on top of the frame 9 so as to be raised or lowered by and together with the frame 9 along the guide shaft 10.

In FIG. 2, the cam 12 and the sheet discharge zone 17 are described to be at approximately the mid part with respect to the numbers of the trays above and below the cam. In this particular instance, the sheet pathway 11 is substantially horizontal.

Referring to FIGS. 2 and 3, the operation of the cam 12 is now explained. When the motor 18 drives the rotary drive shaft 13 to rotate clockwise, the pin 14A of the tray 14 which is immediately under the cam 12 is first caught by the wedge section 12D of the cam and then guided into the slot 12B. As the rotary drive shaft 13 keeps its rotation the pin 14A is moved upwardly as shown in broken lines in FIG. 3. One revolution of the rotary drive shaft 13 in the clockwise direction will cause the pin 14A to move up from the bottom to the top of the cam 12. Thereafter, the pin 14A is held on top of the cam. As the pin 14A enters the slot 12B of the cam, the cam descends by the amount corresponding to one stage of tray, and the cam will then be on the succeeding pin which is immediately below the pin having just entered the slot 12B. Since the frame 9 is adapted to move vertically together with the cam 12 and the rollers 6, 8, the descent of the cam 12 will cause the forward (with respect to the sheet feed direction) ends of the conveyor belt 7 and the pair of sheet guide plates 11A and 11B to descend.

In case the rotational direction of the bidirectional motor 18 is reversed, and the motor 18 causes the rotary drive shaft 13 and the cam 12 to rotate counterclockwise, the pin of the tray resting on top of the cam 12 will enter the helical cam slot 12B and will thereafter be guided downwardly by the slot to the bottom of the cam, whereby the tray will descend from the top to the bottom of the cam. Thus, the trays 14 in the area above the cam can be moved to the area below the cam, one by one at each successive counterclockwise rotation of the rotary drive shaft and the cam. As one tray has been displaced from the area above the cam 12 to the area therebelow, the cam ascends by an amount corresponding to one stage of tray, whereby the cam 12, frame 9 and the rollers 6, 8 integrally ascend by the equal amount.

The foregoing description has been made with respect only to the set of mechanism disposed on one side of the trays 14. A second set of mechanism, which is substantially identical to the one described in FIGS. 1 to 3, comprising a second cam having a second helical slot, a second rotary drive shaft, a second frame, a second guide shaft, and a second coil spring, etc., is also disposed on the opposite side of the trays 14. However, no motor nor static electricity discharge brush is included in the second set of the mechanism.

The cam 12 and the frame 9 and the second cylindrical cam and the second frame of the second set of mecanism are arranged to maintain an equal level each other, respectively. In the present embodiment, the helical direction of the second helical slot of the second cam is same as that of the cam 12. The second rotary drive shaft is drivably coupled to the rotary drive shaft 13 by a gear/toothed-belt arrangement. Thus the drive shaft 13 and the second drive shaft can be rotated simultaneously in the same direction by the motor 18.

Alternately, the helical direction of the second helical slot of the second cam may be made in a mirror image relation against that of the cam 12. In such a case, the toothed belt is arranged in an 8-shaped loop, and the second rotary drive shaft and the rotary drive shaft 13 are rotated simultaneously in the opposite direction from each other. Further, in a modified embodiment, a chain may be used as a substitute for the toothed-belt.

In the present embodiment, one revolution in the clockwise direction of the rotary drive shaft 13 will cause the cam 12 to catch the tray pin immediately below the cam 12 and raise the tray to the upper surface of the cam 12; simultaneously lowering the cam 12 and the sheet discharge zone 17 by an amount corresponding to one stage of the tray having just been raised. The tray having just been raised to the top of the cam 12 forces up the group of trays which have been already on the cam 12. Thus, successive clockwise rotations of the rotary drive shaft 13 will raise the group of trays below the cam 12, one tray at one revolution of the cam, to the upper section of the cam.

The foregoing explanation has been made in reference to the first set of the mechanism on one side of the trays 14. Exactly the same will occur with the second set of the mechanism disposed on the other side of the trays 14. Also, the descriptions of operation hereinafter made in reference to the first set of the mechanism are equally applicable to the second set of the mechanism.

Figure 4:
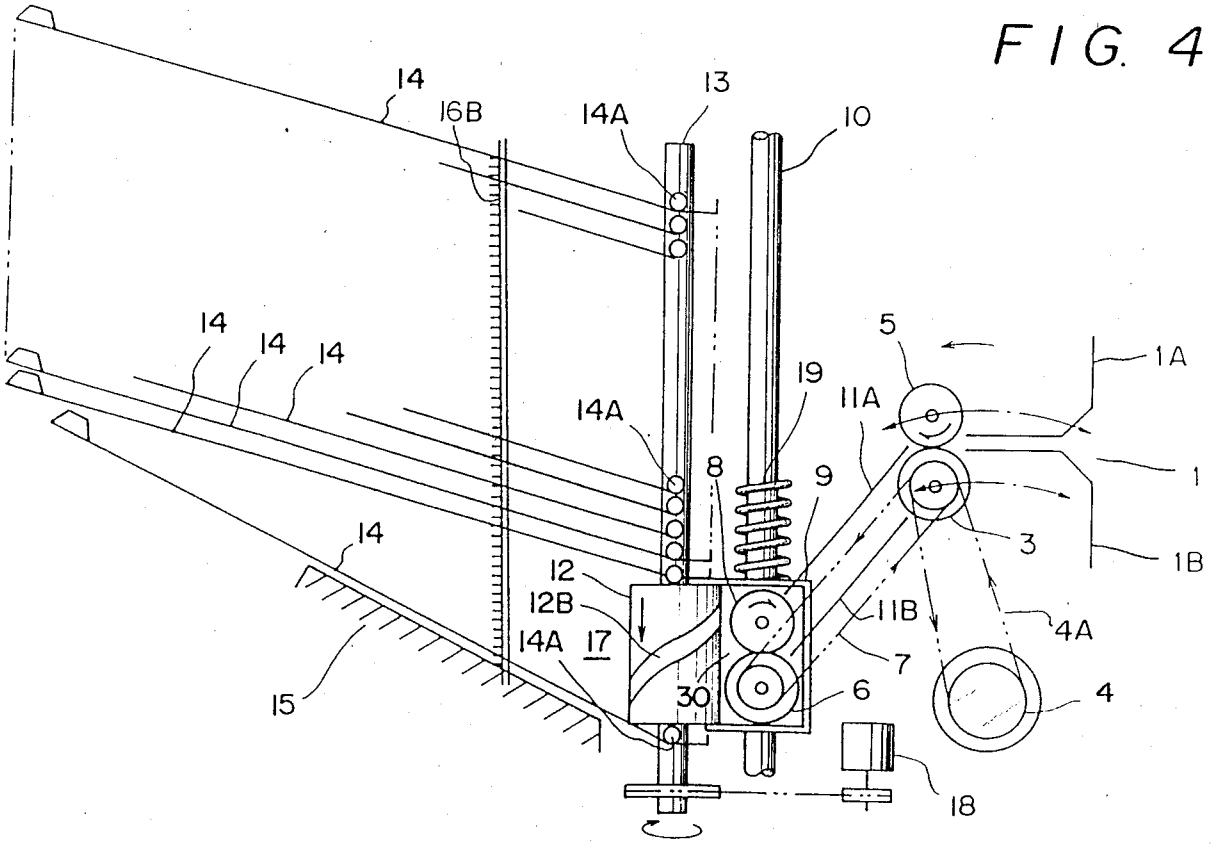
FIG. 4 and FIG. 5 are side elevational schematic views in cross section, similar to FIG. 2, each describing a displaced state of the mechanisms shown in FIG. 2.

In FIG. 4, all of the trays 14 except the lowermost tray are shown to be above the cam 12. In this instance, sheet discharge zone 17 is formed between the lowermost tray and the second lowermost tray, and the sheets are to be introduced onto the lowermost tray which serves as the receiving tray. In this instance, the sheet conveyor belt 7 and the pair of sheet guide plates 11A and 11B form the steepest decending sheet pathway; and the rollers 3, 5 and the drive belt 4A have now moved to a forward limit position rotatingly counterclockwise about the shaft of the motor 4.

Figure 5:
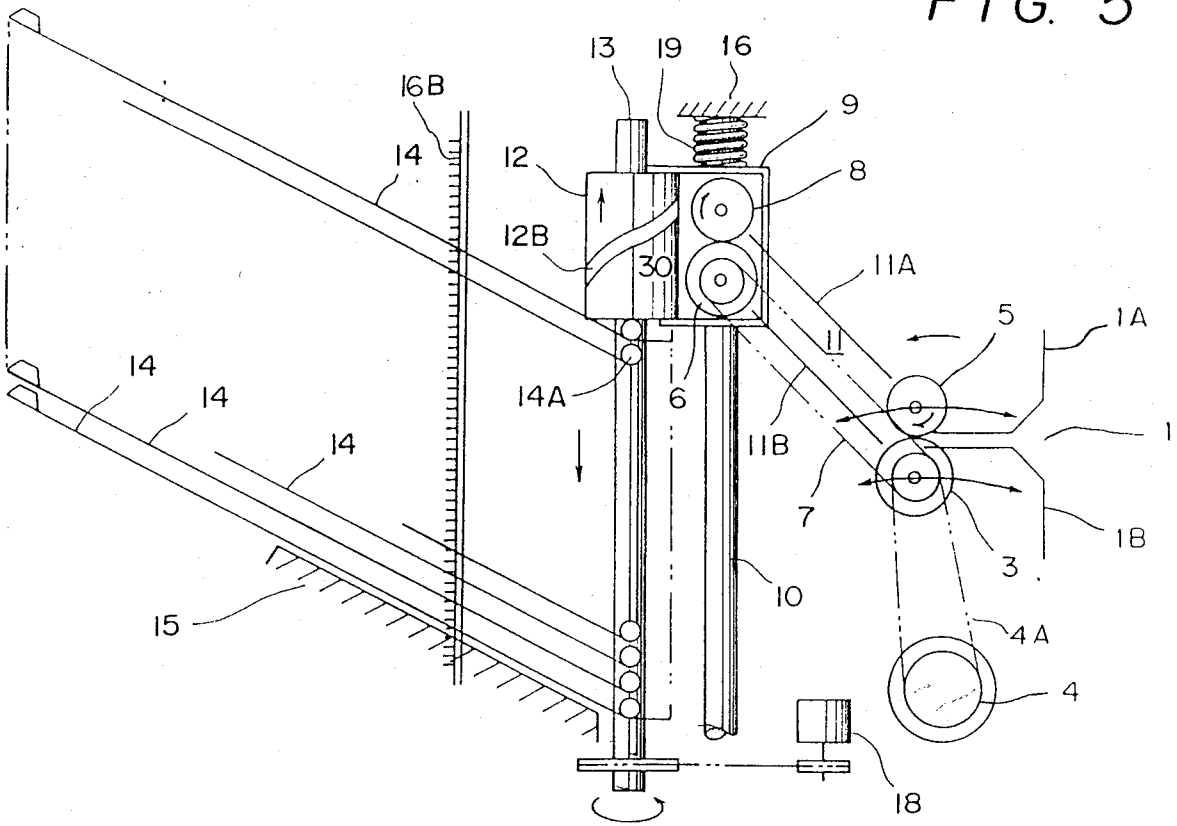

In FIG. 5, all of the trays 14 are shown to be below the cam 12. That is, all of the trays 14 have been moved down and the cam 12 rests on the pin of the top tray, and the sheet discharge zone 17 is situated above the top tray, whereby the sheets are to be introduced onto the top tray which serves as the receiving tray. In this instance, the sheet conveyor belt 7 and the pair of sheet guide plates 11A an 11B form the steepest ascending sheet pathway; and the rollers 3, 5 and the drive belt 4A have now moved to the other forward limit position rotatingly counterclockwise about the shaft of the motor 4.

Referring now to FIGS. 2 to 5, the cam 12 is subjected to a substantial downward force by the weights of the trays and the sheets deposited on the trays, when the trays and the sheets, if present, are situated above the cam 12. Such downward force will assist the wedge section 12D of the cam 12 in catching the pin of the tray immediately under the cam when the tray is to be raised from the bottom to the top of the cam 12. In other words, without being assisted by said downward force, the wedge section 12D may fail to catch the pin and failure in raising the tray may result. It goes without saying that the higher the level of the cam 12, the less gravitational force of the trays and the sheets will exert the cam.

Referring to FIG. 5, the arrangement of the coil spring 19 is such that the upward movement of the coil spring 19 is blocked by the frame 16 supporting the guide shaft 10 in its top end. The coil spring 19 starts to be compressed and to downwardly urge the frame 9, together with the cam 12, as soon as the coil spring 19 has come into contact with the frame 16 in its upward movement. The coil spring 19 functions as a complement or a substitute for any insufficiency of said gravitational force of the trays and the sheets so that no failure of tray raising operation will result. FIG. 5 describes the coil spring 19 in its compressed state as opposed to its fully extended state described in FIG. 4.

Figure 6:
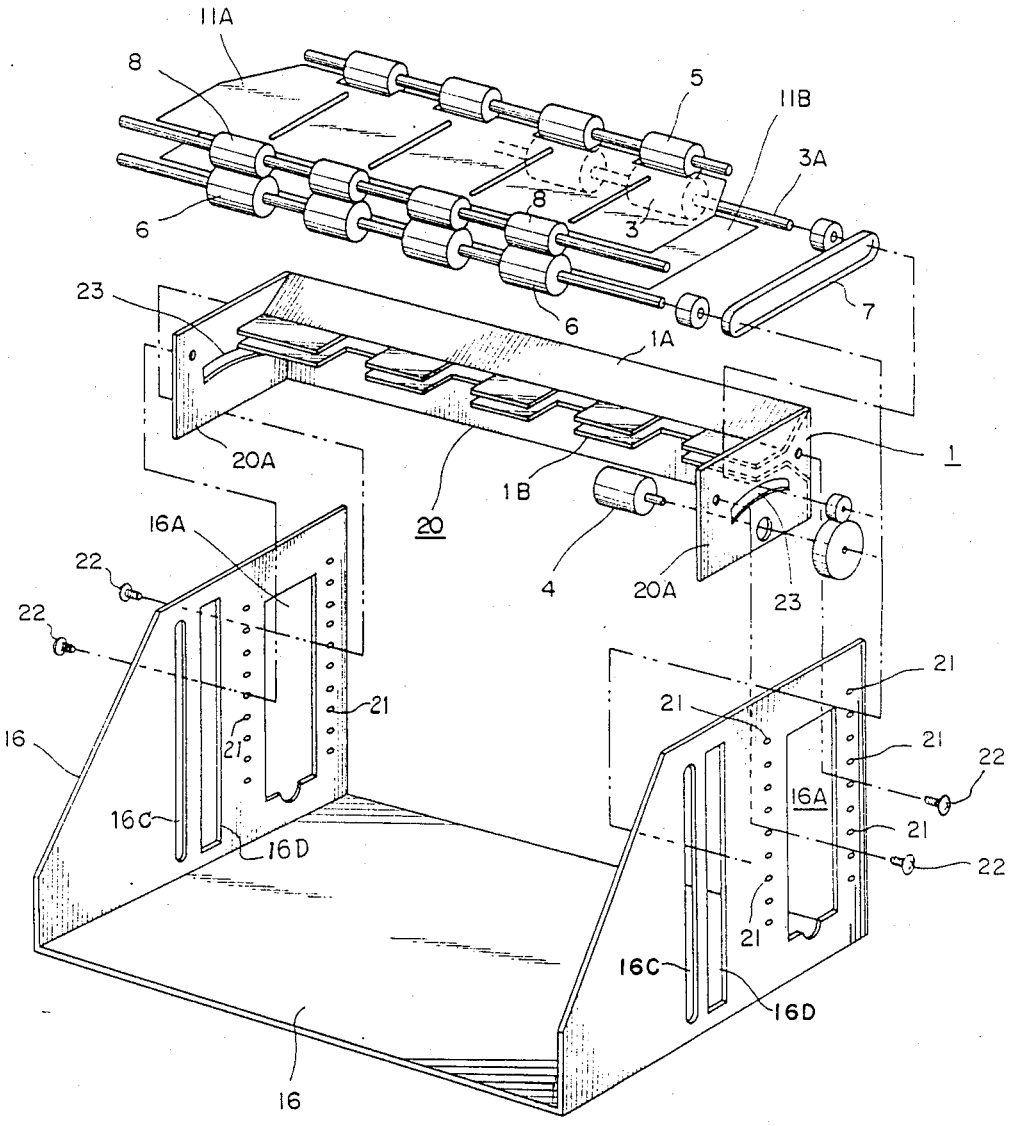
FIG. 6 is an exploded perspective view describing an embodiment of an adjustable sheet inlet mechanism of a sheet sorting device of the present invention.

Referring to FIGS. 1 and 6, the sheet inlet level adjustable mechanism is now described in detail. A pair of cutouts 16A are provided in opposite positions of the side sections of the frame structure 16. A plurality of screw holes 21 are provided in the side sections of the frame structure, vertically aligned and equally spaced, along each of the side edges of the cutouts 16A. These screw holes are for removably securing the level adjustable sheet inlet mechanism 20 to the frame structure by means of screws 22 at a desired level so that the sheet inlet 1 meets the sheet discharge level of the image printing apparatus.

Referring to FIG. 6, the level adjustable mechanism 20 comprises the sheet guides 1A and 1B and a pair of flanges 20A each of which is rigidly coupled to each end of the sheet guides 1A and 1B. The sheet feed motor 4 is mounted on one of the flanges 20A. Circular arcuate slots 23 are oppositely provided in the flanges so that the shaft 3A of the sheet feed roller 3 engages therewith and is slidingly movable about the shaft of the motor 4. An oppositely disposed pair of clearances 16D allow the shafts of the rollers 6, 8 to vertically move therethrough. In this embodiment described in FIG. 6, frictional rollers are used for the motor power transmission to the shaft 3A in contrast to the pulley-belt arrangement as described in FIGS. 1, 2, 4 and 5.

In an alternate embodiment, the frame structure can be provided with oppositely disposed vertical guide slots or rails, and the flanges can be provided with pins or the like to slidably engage with the the guide slots or rails, or vice versa, so that the sheet inlet level adjustable mechanism can be vertically slidably movable along the guide slots or rails for the level adjustment.

Figure 8:
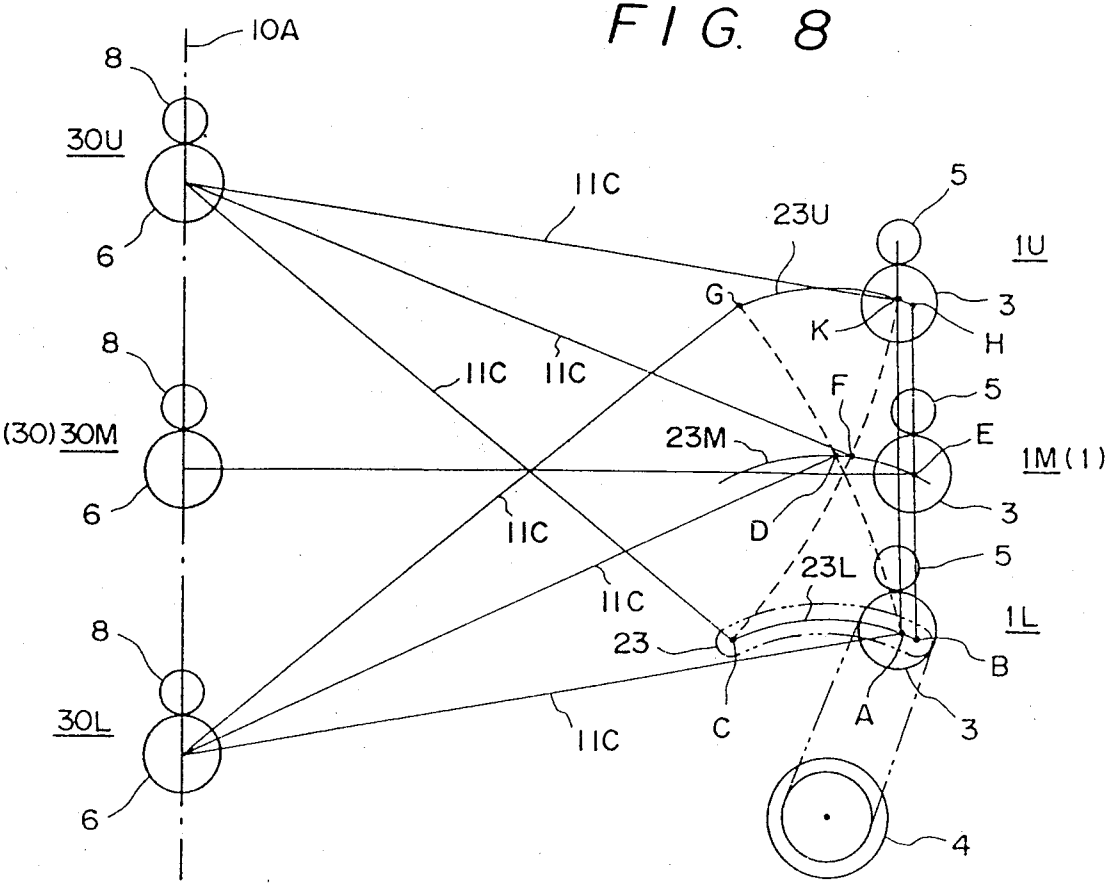
FIG. 8 is a diagrammatic illustration for the displacements of the sheet feeding mechanisms employed in a sheet sorting device of the present invention.

Referring to FIG. 8, the displacements of the sheet feeding mechanism is hereinafter described in reference to the cases wherein various sheet inlet levels are set. A sheet discharge position 30 is defined as the position between the rollers 6, 8 wherefrom the sheets are discharged toward the sheet discharge zone onto the recediving tray. Three exemplified sheet discharge positions 30U, 30M and 30L are schematically illustrated along the axis 10A of the guide shaft 10 for the uppermost, middle and lowermost positions, respectively. On the other hand, three exemplified positions 1U, 1M and 1L are schematically shown representing the uppermost, middle and lowermost positions, respectively, of the sheet inlet 1. Center lines of the circular arcuate slots are represented by the curved lines 23U, 23M and 23L corresponding to the uppermost (1U), middle (1M) and lowermost (1L) positions of the sheet inlet 1, respectively.

Now, the position of the sheet inlet 1 is assumed to be set at the lowermost position 1L. As the sheet dischage position 30 upwardly shifts from its lowermost position 30L to the uppermost position 30U, the center of the roller 3 moves along the line 23L first from A to B, then from B to C. The distance between the centers of the rollers 3 and 6, represented by the lines 11C, is constant because the shafts of the rollers 3 and 6 are mechanically linked each other by the sheet guide plate 1B which is pivotable at each end.

In case the the position of the level of the sheet inlet 1 is set at the middle position 1M and the sheet discharge position 30 upwardly shifts from its lowermost position 30L to the uppermost position 30U, the center of the sheet feed roller 3 moves along the line 23M first from D to E, then from E to F.

Further, in case the position of the level of the sheet inlet 1 is set at the uppermost position 1U and the sheet dischage position 30 upwardly shifts from its lowermost position 30L to the uppermost position 30U, the center of the sheet feed roller 3 moves along the line 23U first from G to H, then from H to K.

The level of the sheet inlet 1 can be initially set at a proper level, within the level range from 1L to 1U, so that the level meets the sheet discharge level of the image printing apparatus without affecting the functions of the sheet receiving from the image printing apparatus and the sheet conveying from the sheet inlet 1 to the sheet discharge zone 17 through the sheet discharge position 30.

Figure 7:
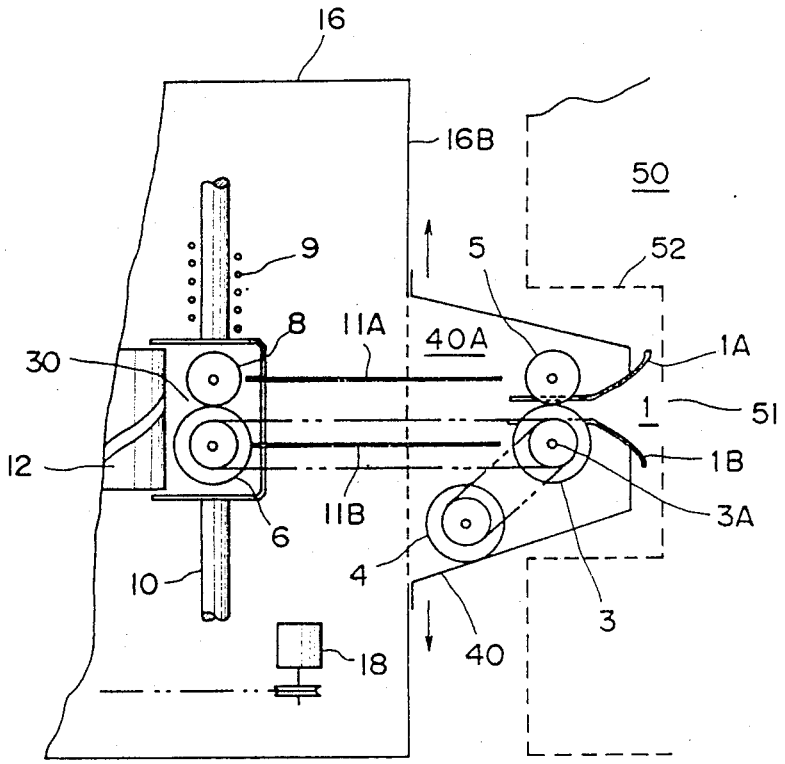
FIG. 7 is a side elevational schematic view in cross section describing another embodiment of an adjustable sheet inlet mechanism of a sheet sorting device of the present invention.

Another embodiment of sheet inlet level adjustable mechanism is described in FIG. 7. The pair of sheet guides 1A and 1B, the sheet feed rollers 3 and 5, the shaft 3A, the motor 4 and the drive belt are enclosed by a case 40 and coupled thereto, whereby an encased sheet inlet level adjustable mechanism 40A is formed. The encased sheet inlet level adjustable mechanism 40A is removably secured to the front section 16B of the frame structure 16 of the sheet sorting apparatus by means of screws or the like fastening means, whereby the level of the mechanism 40A can be adjusted as shown by the arrows in FIG. 7. The internal parts and the structure of the mechanism 40A are basically the same as the ones described in FIGS. 1 and 6. FIG. 7 further describes, in broken lines, an image printing appratus 50 including a sheet dischage section 51 and a recessed section 52 wherein the sheet dischage section 51 is disposed. The encased sheet inlet level adjustable mechanism 40A can be positioned being fit in the recessed section 52 of the image printing apparatus, whereby sheet transfer from the image printing apparatus having a recessed sheet discharge section to the sheet sorting apparatus is made possible.

Figure 9:
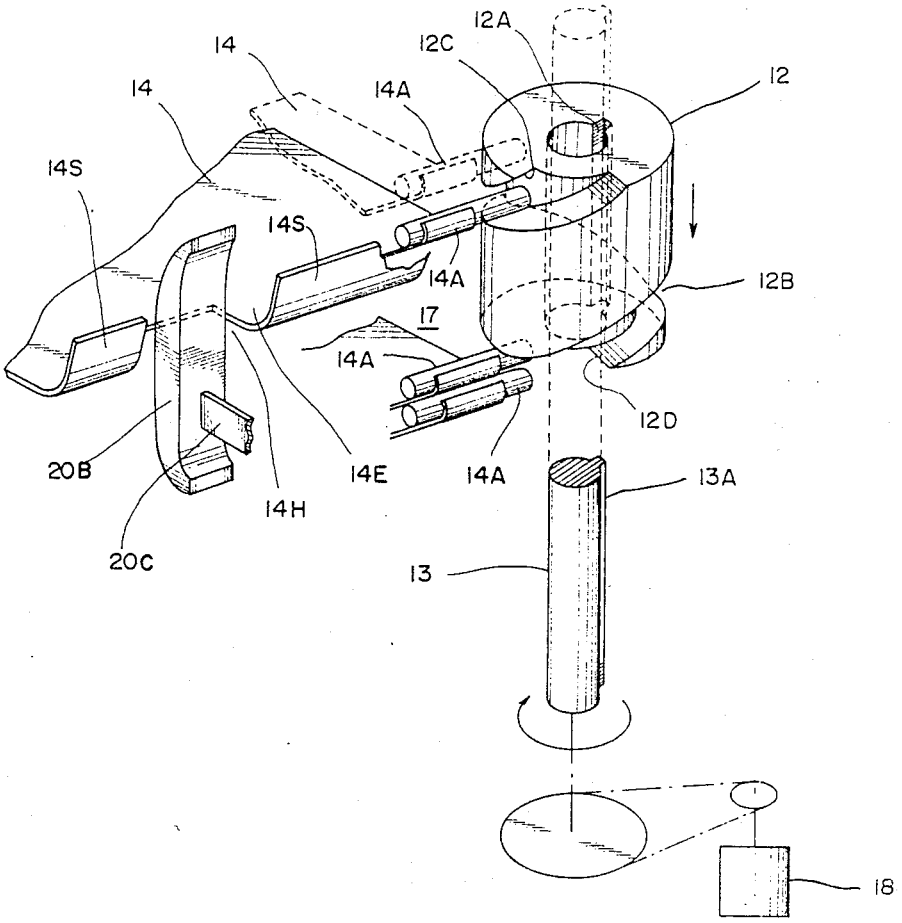
FIG. 9 is a perspective view of a section of a sheet sorting device incorporating a sheet edge guide of the present invention.
Figure 10:
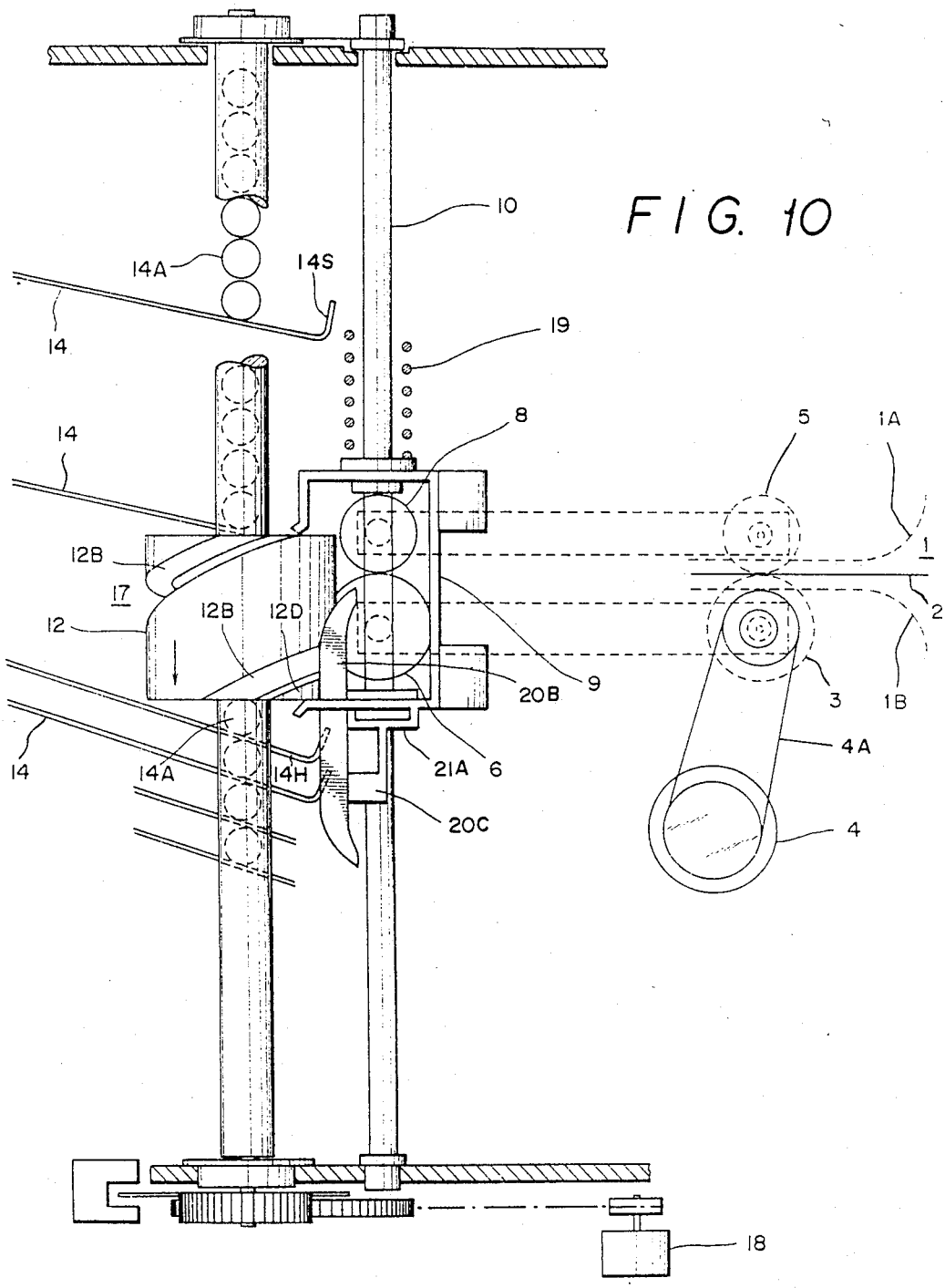
FIG. 10 is a side elevational view in cross section of the sheet sorting device incorporating the sheet edge guide shown in FIG. 9.

FIGS. 9 and 10 describe another embodiment of the present invention. Referring to FIGS. 9 and 10, a plurality of vertically extended sheet edge guides 20B are disposed in the vicinity of the downward end 14E of the receiving tray.

Referring to FIG. 10, a bracket 21A is an elongated member which transversely extends through the clearances 16D (shown in FIG. 6), each end thereof is rigidly affixed to each bottom section of the frame 9 and the second frame, respectively. The bracket 21A has a plurality of arms 20C which are transversely evenly spaced along the bracket 21A. Each of the sheet edge guides 20 is rigidly coupled to each of the arms.

Each of the trays has a plurality of risers 14S at the downward end 14E thereof in order to prevent sheets from slipping down therefrom. There are provided cut sections 14H between the risers 14S along the downward end 14E of each tray so that the sheet edge guides 20B fit in the corresponding cut sections 14H, whereby the trays 14 and the sheet edge guides 20B do not interfere with each other when the trays and the sheet edge guides vertically shift.

Sheet alignment problems have been often observed with conventional sheet sorting apparatus employing a similar arrangement of shiftable trays. Namely, the sheets deposited on each tray do not clearly align with one another, due to static electricity or otherwise, and the improper or misaligned positioning of the sheets on the tray may result in sheet jamming.

In the present invention, the sheet edge guides 20B are provided in order to obviate such problems. The function of the sheet guides is hereinafter explained. An assumption is made that the sheets have been deposited on the receiving tray, but not properly aligned with one another or with the downward end 14E of the tray, and the tray is to be raised in the next tray moving sequence. Since the sheet edge guides 20B are rigidly affixed to the frame 9 and the frame 9 is coupled to the cam 12, the sheet edge guides 20B will follow the vertical movements of the cam 12. As the tray moves upwardly to the top of the cam 12, the sheet edge guides 20B descend by one tray stage, whereby the sheet edge guides lightly rub against the trailing edges of the sheets and cause the sheets to be aligned with one another and with the downward end of the tray. downward end of the tray.

Conversely, in case the tray immediately above the cam 12 descends to the bottom of the cam, the sheet edge guides 20B will ascend by one tray stage and the sheet edge guides will lightly rub against the trailing edges of the sheets deposited on the decending tray, thereby causing the trailing edges of the sheets to be aligned with one another and with the downward end of the tray.

The upper and the lower sections of each of the sheet edge guides 20 are bent toward the direction away from the deposited sheet, as described in FIGS. 9 and 10, so that the trailing edges of the sheets are firstly guided by the curved surface of the upper or lower bent section of each of the sheet edge guides 20B and then by the surface of the straight section formed between the upper and lower bent sections.

The sheet edge guides 20B may be made of any material if the material is suitable for producing a very smooth surface where the sheet edge guides make contact with the trailing edges of the sheet. However, the sheet guides 20B are preferably made of an electrically conductive material and the sheet edge guides are electrically grounded so that the sheet edge guides help discharge any static electricity which may be accumulated on the sheets deposited on the trays, during upward or downward movements thereof, keeping contacts with the trailing edges of the sheets. One practical method for achieving this object is to use the bracket 21A, arms 20C, the frame 9, bearings thereof engaging the guide shaft 10, and the guide shaft 10 of electrically conductive material and to make the guide shaft 10 electrically grounded.

While the invention has been described with reference to the preferred embodiments disclosed, it is not confined to the details set forth, but is intended to cover such modifications or changes as may come within the scope of the following claims.

What is claimed is:

1. A sheet sorting apparatus used with an image printing apparatus, comprising:

(a) a frame structure;

(b) a pair of vertically disposed drive shafts rotatably coupled to said frame structure;

(c) means for simultaneously rotating said drive shafts;

(d) a plurality of trays arranged in a vertical array for receiving copy sheets and shiftably coupled to said frame structure;

(e) a pair of cams each vertically movably engaged with each of said drive shafts for shifting said trays;

(f) a pair of vertically disposed guide shafts fixedly coupled to said frame structure;

(g) a pair of frames each vertically movably mounted on each of said guide shafts and coupled to each of said cams;

(h) means for downwardly urging each of said frames, thereby downwardly urging each of said cams; and (i) a sheet feeding means for feeding said copy sheets onto said trays.

2. A sheet sorting apparatus according to claim 1, wherein said sheet feeding means comprises:

(a) a sheet inlet unit coupled to said frame structure for accepting said copy sheets from said image printing apparatus;

(b) a first sheet feed roller rotatably coupled to sheet inlet unit;

(c) a second sheet feed roller rotatably coupled to said frames and drivenly coupled to said first sheet feed roller so as to maintain a constant distance therefrom;

(d) a sheet guide means tiltably coupled to said first feed roller and said second sheet feed roller; and (e) means for driving said first sheet feed roller and said second sheet feed roller.

3. A sheet sorting apparatus according to claim 2, wherein the level of said sheet inlet unit is adjustable so as to meet the level of the sheet discharge outlet of said image printing apparatus.

4. A sheet sorting apparatus according to claim 1, further comprising sheet aligning means for aligning said copy sheets.

5. A sheet sorting apparatus according to claim 2, wherein said means for driving said first sheet feed roller and said second sheet feed roller is a rotational motor having a shaft.

6. A sheet sorting apparatus according to claim 5, wherein said sheet inlet unit comprises:

(a) a pair of oppositely disposed flanges, each thereof removably coupled to said frame structure for adjusting the level of said sheet inlet unit, said motor being mounted to one of said flanges;

(b) a pair of horizontally disposed sheet guides, the end of each thereof rigidly coupled to each of said flanges, thereby providing a horizontally extended opening therebetween for accepting said copy sheets from said image printing apparatus;

(c) a pair of circular arcuate slots each oppositely provided in each of said flanges; and (d) a shaft for said first sheet feed roller, each end thereof engaged with each of said circular arcuate slots and slidingly rotatingly movable about the shaft of said motor.

7. A sheet sorting apparatus according to claim 4, wherein said means for aligning said copy sheets comprises:

(a) an elongated transversely extended bracket, each end thereof rigidly affixed to each of said frames; and (b) a plurality of sheet edge guides rigidly coupled to said bracket, each having a surface for making contact with the trailing edges of said copy sheets for alignment thereof.

* * * * *